US008147085B2

(12) United States Patent
Pieren

(10) Patent No.: US 8,147,085 B2
(45) Date of Patent: Apr. 3, 2012

(54) ILLUMINATING SPRINKLER VALVE ON/OFF KEY

(76) Inventor: Danny Harold Pieren, Reno, NV (US)

( * ) Notice: Subject to any disclaimer, the term of this patent is extended or adjusted under 35 U.S.C. 154(b) by 207 days.

(21) Appl. No.: 12/799,776

(22) Filed: May 1, 2010

(65) Prior Publication Data

US 2011/0265609 A1 Nov. 3, 2011

(51) Int. Cl.
*F21V 33/00* (2006.01)

(52) U.S. Cl. ..... 362/119; 362/96

(58) Field of Classification Search ..... 362/96, 362/101, 103, 119, 120; 81/177.1, 488, 489; 239/201, 203, 289, 600; 7/167
See application file for complete search history.

(56) References Cited

U.S. PATENT DOCUMENTS 4,788,894 A * 12/1988 Mitschele ..... 81/488
6,379,020 B1 * 4/2002 Lewis et al. ..... 362/120
6,978,504 B1 * 12/2005 Smith et al. ..... 7/165
2005/0087045 A1 * 4/2005 Gryciuk et al. ..... 81/436

* cited by examiner

*Primary Examiner* — Thomas Sember

(57) ABSTRACT

Herein disclosed is a sprinkler valve on/off key that includes a light source therein. The sprinkler valve on/off key includes a gripping member which is of a shape and size to mate with a standard sprinkler head/valve. The light source is housed within the gripping member and when the light source is energized the light illuminates the area around the gripping member and the sprinkler head assembly. Whereby, the workman can visually see and easily manipulate the sprinkler head/valve assembly between the on and off position.

3 Claims, 2 Drawing Sheets

10

ILLUMINATING SPRINKLER VALVE ON/OFF KEY

FIELD OF THE INVENTION

This invention relates in general to hand tools used for manipulating sprinkler water valves and the like. More particularly the invention pertains to a standard sprinkler valve on/off key that includes a light therein for illuminating the area around the sprinkler head assembly.

BACKGROUND OF THE INVENTION

It is well known within the landscaping and/or irrigation business that sprinkler keys are typically used at the work site to manually turn sprinkler heads/valves either on or off. In most cases the sprinkler head and/or valve is commonly positioned within an access hole underground and is only accessible via use of a standard sprinkler key. The standard sprinkler key is substantially a T-shaped tool which is of a length to extend downward into the access hole. The elongated downward leg of the T-shaped tool includes a gripping member which is of a shape and size to mate with the standard sprinkler head and/or valve stem. In use, when the sprinkler key is inserted into the access hole the workman must manipulate the gripping member in a somewhat circular pattern until the gripping member fits over and/or onto the sprinkler head and/or valve stem in a mating relationship. Upon engagement and locking the gripping member onto the sprinkler head/valve, the workman can then turn the key and regulate the sprinklers water flow between an open and closed position.

However, alignment between the gripping member and the sprinkler head/valve can be very difficult, frustrating and time consuming as the workman cannot visually see downward into the access hole. Thus, the workman relies solely on manipulating the key into proper engagement by "feel" and "guesswork" alone. Therefore, if the sprinkler valve on/off key were to include a light source to illuminate the gripping member and sprinkler head/valve, this would be a great advantage and simply the overall process.

Within the known prior art there has never been heretofore a sprinkler valve on/off key that includes any type of light or the like. However, workman have recognized this problem within other fields, such as electricians and the like who often work in poorly-lit environments. As a result, they invented some standard type hand tools (such as screwdrivers and nut-drivers) that include a light for illuminating nuts, bolts, screws, etc. For example, U.S. Pat. Nos. 2,242,536, 4,324,158 and 5,577,829 disclose tools having some type of light source. However, the applicant could not find any references wherein a sprinkler valve on/off key is utilized for illuminating the gripping member and sprinkler head/valve that is located within an access hole below ground.

OBJECTS AND ADVANTAGES OF THE PRESENT INVENTION

It is therefore a primary object of the present invention to provide an illuminating sprinkler valve on/off key that includes means for illuminating the gripping member associated with the sprinkler valve on/off key and the sprinkler head/valve.

Another object of the present invention is to provide an illuminating sprinkler valve on/off key that includes a compartment for containment of a power source, such as a battery, an on/off switch, an internal aperture for containment of electrical leads and a light source.

Yet another object of the present invention is to provide an illuminating sprinkler valve on/off key that overcomes the disadvantages, drawbacks and problems associated with standard sprinkler valve on/off keys.

Another important object of the present invention is to provide an illuminating sprinkler valve on/off key that greatly improves efficiency, saves time and simplifies the process for the workman.

Still a further object of the present invention is to provide an illuminating sprinkler valve on/off key that is economically cost effective to manufacture, market and sell.

Another object of the present invention is to provide an illuminating sprinkler valve on/off key that is not limited to any specific type of sprinkler head or valve assembly. The gripping member may be interchanged if desired and/or the invention may be produced having different types of gripping members depending on engineering choice.

Other objects and advantages will be seen when taken into consideration with the following specification and drawings.

DETAILED DESCRIPTION OF THE DRAWINGS

Figures 1, 2:
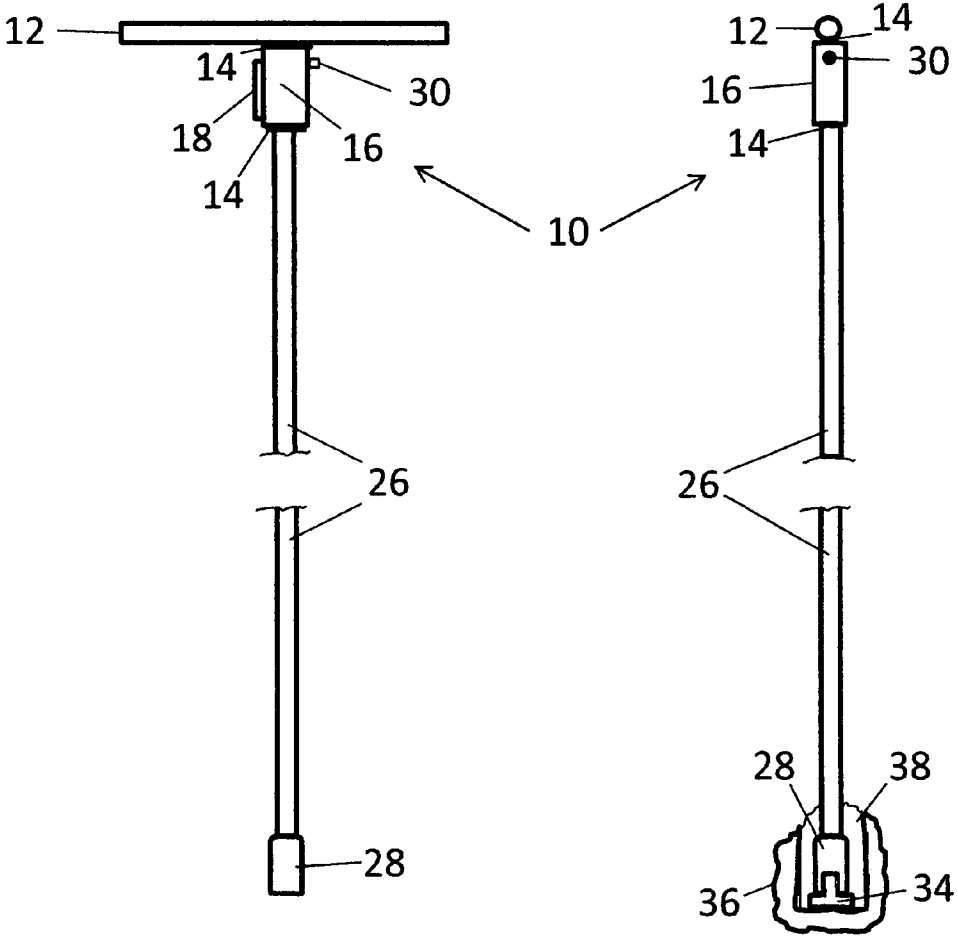
FIG. 1 is substantially a front view of the present invention.
FIG. 2 is substantially a side view of FIG. 1.

Referring now in detail to the drawings wherein like characters refer to like elements throughout the various views. As illustrated (10) substantially represents an overview of the present illuminating sprinkler valve on/off key. It is to be understood the overall construction of the present invention can be made from any suitable materials of engineering choice, such as stainless steel or the like. Also it is to be noted the internal illuminating components are weather-proofed for safety. In general, the illuminating sprinkler valve on/off key (10) includes an elongated horizontal handle (12) which can be made from any material of choice, such as a hollow pipe or the like. The elongated horizontal handle (12) is fixedly attached by suitable attachment means of choice such as welding (14) onto a hollow container (16). The hollow container (16) includes an access panel (18) which allows access into the internal hollow compartment (20) (only depicted in FIG. 3) of the hollow container (16). The internal hollow compartment (20) houses a power source such as a battery (22) and electrical leads (24 & 25). The hollow container (16) is further fixedly attached by suitable attachment means of choice such as welding (14) onto the top end of an elongated vertical member (26), which may be made from a pipe or the like. The bottom end of the elongated vertical member (26) includes a sprinkler head/valve gripping member (28). It is to be noted different types of sprinkler head/valve gripping members and different types of sprinkler head/valves (34) can be incorporated depending on engineering choice as long as the gripping member (28) and the sprinkler head/valve (34) assemblies have a mating relationship when interconnected. Thus the sprinkler head/valve gripping member (28) and the sprinkler head/valve (34) as depicted in FIG. 2 are only illustrative of one standard sprinkler head/valve gripping member and one standard type sprinkle head/valve. Furthermore, the gripping member maybe fixedly attached such as by welding (not shown) or the like. Or if preferred the gripping member (28) maybe removably attached such as by threads, a friction fit, etc., depending on engineering choice. Whereby, the invention is not to be limited to any specific types or interconnections thereof.

Figure 3:
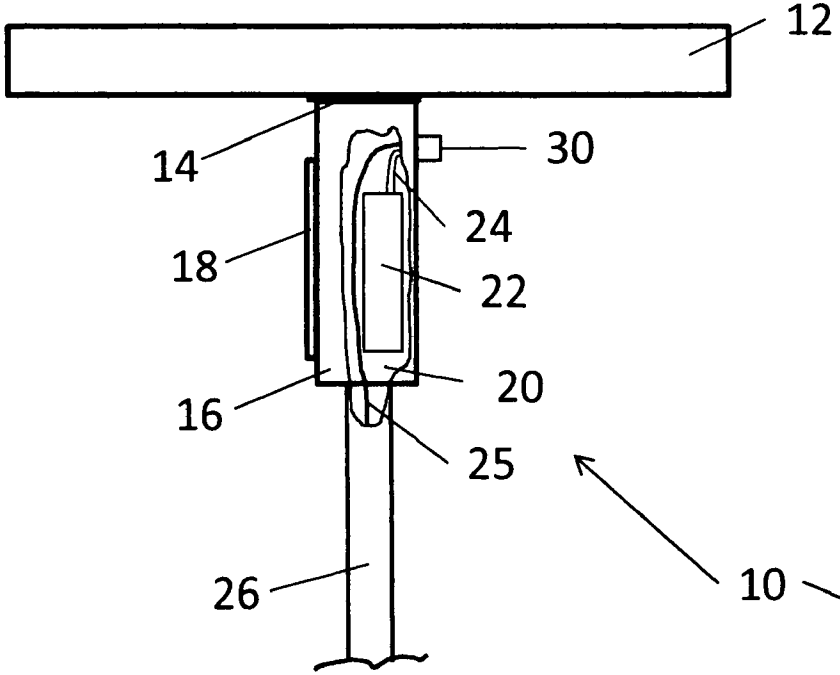
FIG. 3 is substantially an enlarged view depicting a portion of the top section of the present invention.
Figure 4:
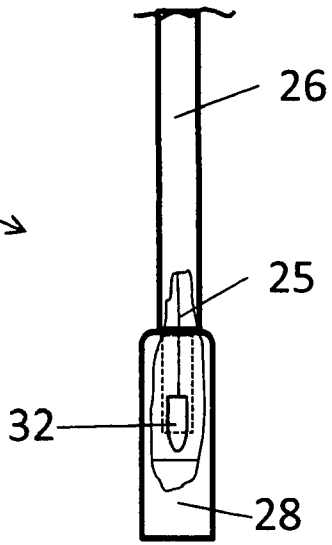
FIG. 4 is substantially an enlarged view depicting a portion of the bottom section of the present invention.

Referring now in particular to FIGS. 3 & 4, of which more clearly depict the internal components of the invention. Namely, the power source such as battery (22) is in electrical communication with a standard on/off switch (30) via standard electrical leads (24) and the on/off switch (30) is in electrical communication with a standard on/off light source such as light bulb (32) via standard electrical lead (25). As depicted the electrical lead (25) from the standard on/off switch (30) is thread ably inserted into and throughout the internal hollow passageway within the elongated vertical member (26) and is interconnected onto the light source such as bulb (32) of which is housed within the sprinkler head/valve gripping member (28).

It can now be seen the workman upon locating the sprinkler head/valve (34) which is typically buried in the earth (36), then turns on the on/off switch (30) which in turn illuminates the light source, namely light bulb (32). Upon illumination the workman aligns the sprinkler head/valve gripping member (28) over the access hole (38), wherein the sprinkler head/valve (34) is located and then inserts the illuminated sprinkler valve on/off key (10) downward into the access hole (38) until the sprinkler head/valve gripping member (28) is aligned onto the sprinkler head/valve (34) and upon engagement therewith the sprinkler head/valve gripping member (28) and the sprinkler head/valve attain the mating relationship (due to the visual aid of the light bulb (32). Thereafter the workman can manually turn the handle (12) until the sprinkler head/valve (34) attains either the on or off position of choice, respectively. Thereafter, upon removal of the illuminated sprinkler valve on/off key (10), the workman can either leave the on/off switch (30) in the "on" position and move to the next sprinkler head/valve (34), or turn the on/off switch (30) to the "off" position, either of which may be the desired need at hand.

It can now be seen I have herein provided an illuminating sprinkler valve on/off key (10) which is novel and heretofore has not been taught or conceived. The illuminating sprinkler valve on/off key (10) is of simple operation and construction and allows a workman to visually and easily locate the sprinkler valve head/valve (34) and align the illuminated sprinkler valve on/off key (10) thereon for actuation thereof.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

Having described the invention, what I claim as new and desire to secure by Letters Patent is:

1. An illuminating sprinkler valve on/off key comprising in combination: a handle; a hollow container; a power source; a light source; an on/off switch; an elongated vertical member; and a sprinkler head/valve gripping member; said handle is fixedly attached onto said hollow container, said hollow container includes an access panel which allows access into the internal hollow compartment of said hollow container, said internal hollow compartment houses said power source and electrical leads, said elongated vertical member having a top end and a bottom end, said hollow container is fixedly attached onto said top end, said sprinkler head/valve gripping member is attached onto said bottom end, said sprinkler head/valve gripping member and a sprinkler/head valve have a mating relationship when interconnected, said power source is in electrical communication with said on/off switch via said electrical leads, said on/off switch is in electrical communication with said light source via an electrical lead, said electrical lead is threadably inserted into and throughout an internal hollow passageway within said elongated vertical member, said electrical lead is interconnected onto said light source and said light source is housed within said sprinkler head/valve gripping member.

2. The illuminating sprinkler valve on/off key of claim 1 wherein said handle is made from a pipe.

3. The illuminating sprinkler valve on/off key of claim 1 wherein said elongated vertical member is made from a pipe.

* * * * *